US008647141B2

(12) United States Patent
Lee et al.

(10) Patent No.: US 8,647,141 B2
(45) Date of Patent: Feb. 11, 2014

(54) BOARD-TO-BOARD CONNECTOR ASSEMBLY

(75) Inventors: Kuo-Ching Lee, New Taipei (TW); Conrad Yee Yang Choy, New Taipei (TW); Jian-Li Guan, New Taipei (TW); Ya-Ping Liang, New Taipei (TW); Ta-Teh Meng, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 50 days.

(21) Appl. No.: 13/533,665

(22) Filed: Jun. 26, 2012

(65) Prior Publication Data

US 2013/0260594 A1 Oct. 3, 2013

(30) Foreign Application Priority Data

Mar. 29, 2012 (CN) ..... 2012 2 0124243

(51) Int. Cl.
*H01R 13/62* (2006.01)

(52) U.S. Cl.
USPC ..... 439/372

(58) Field of Classification Search
None
See application file for complete search history.

(56) References Cited

U.S. PATENT DOCUMENTS

| | | | | |
|---|---|---|---|---|
| 4,671,594 | A * | 6/1987 | Ohtsuki et al. | 439/347 |
| 6,890,206 | B2 * | 5/2005 | Distad et al. | 439/372 |
| 7,850,478 | B2 * | 12/2010 | Lin et al. | 439/373 |
| 7,862,353 | B1 * | 1/2011 | Azad et al. | 439/157 |
| 8,023,270 | B2 * | 9/2011 | Chen | 361/747 |
| 8,241,065 | B2 * | 8/2012 | Ikari et al. | 439/607.41 |
| 2012/0171890 | A1 * | 7/2012 | Kurachi | 439/372 |

* cited by examiner

*Primary Examiner* — Gary Paumen
(74) *Attorney, Agent, or Firm* — Ming Chow; Sinorica, LLC

(57) ABSTRACT

A board-to-board connector assembly has a female connector and a male connector. The female connector has a first insulative housing, multiple first terminals and a latching bar. The first insulative housing has a locking recess and a releasing recess. The latching bar is mounted pivotally on the first insulative housing and selectively engages the locking recess or releasing recess. The male connector has a second insulative housing, multiple second terminals and two latched elements. The latched elements are mounted in the second insulative housing and each latched element has a latched hole selectively engaging with the latching bar to prevent the male connector from falling out of the female connector.

12 Claims, 8 Drawing Sheets

BOARD-TO-BOARD CONNECTOR ASSEMBLY

The current application claims a foreign priority to the application of China 201220124243.2 filed on Mar. 29, 2012.

BACKGROUND OF THE INVENTION

1. Field of the Invention

The present invention relates to a connector assembly, and more particularly to a board-to-board connector assembly that has a female connector and a male connector. The female connector is capable of locking and preventing the male connector from being inadvertently loosened or detached from the female connector.

2. Description of Related Art

Board-to-board connectors are commonly applied to electronic devices and are mounted on printed circuit boards (PCB). For example, board-to-board connectors are employed between a motherboard and an expansion card so that the motherboard is able to acquire additional functions through different expansion cards. The board-to-board connectors also facilitate replacement and maintenance of expansion cards.

Conventional board-to-board connectors are made as a couple that includes a female connector and a male connector matching the female connector. The female and male connectors are mounted in different PCBs and detachably engage each other by press-fitting manners to prevent inadvertent detachment from each other.

However, after repeated engagements and disengagements, the press-fitting effect between the female and male connector is weakened due to material fatigue or structural deformation. Furthermore, no pull-proof locking mechanism is provided between the male and female connectors so that when one of the PCBs on which the male connector is mounted is inadvertently pulled, the male connector may disengage from the female connector.

To overcome the shortcomings, the present invention provides a board-to-board connector assembly to mitigate or obviate the aforementioned problems.

SUMMARY OF THE INVENTION

The main objective of the invention is to provide a board-to-board connector assembly that has a female connector and a male connector. The female connector is capable of locking and preventing the male connector from being inadvertently loosened or detached from the female connector.

A board-to-board connector assembly in accordance with the present invention comprises a female connector and a male connector. The female connector has a first insulative housing, multiple first terminals and a latching bar. The first insulative housing has a locking recess and a releasing recess. The latching bar is mounted pivotally on the first insulative housing and selectively engages the locking recess or releasing recess. The male connector has a second insulative housing, multiple second terminals and two latched elements. The latched elements are mounted in the second insulative housing and each latched element has a latched hole selectively engaging with the latching bar to prevent the male connector from falling out of the female connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
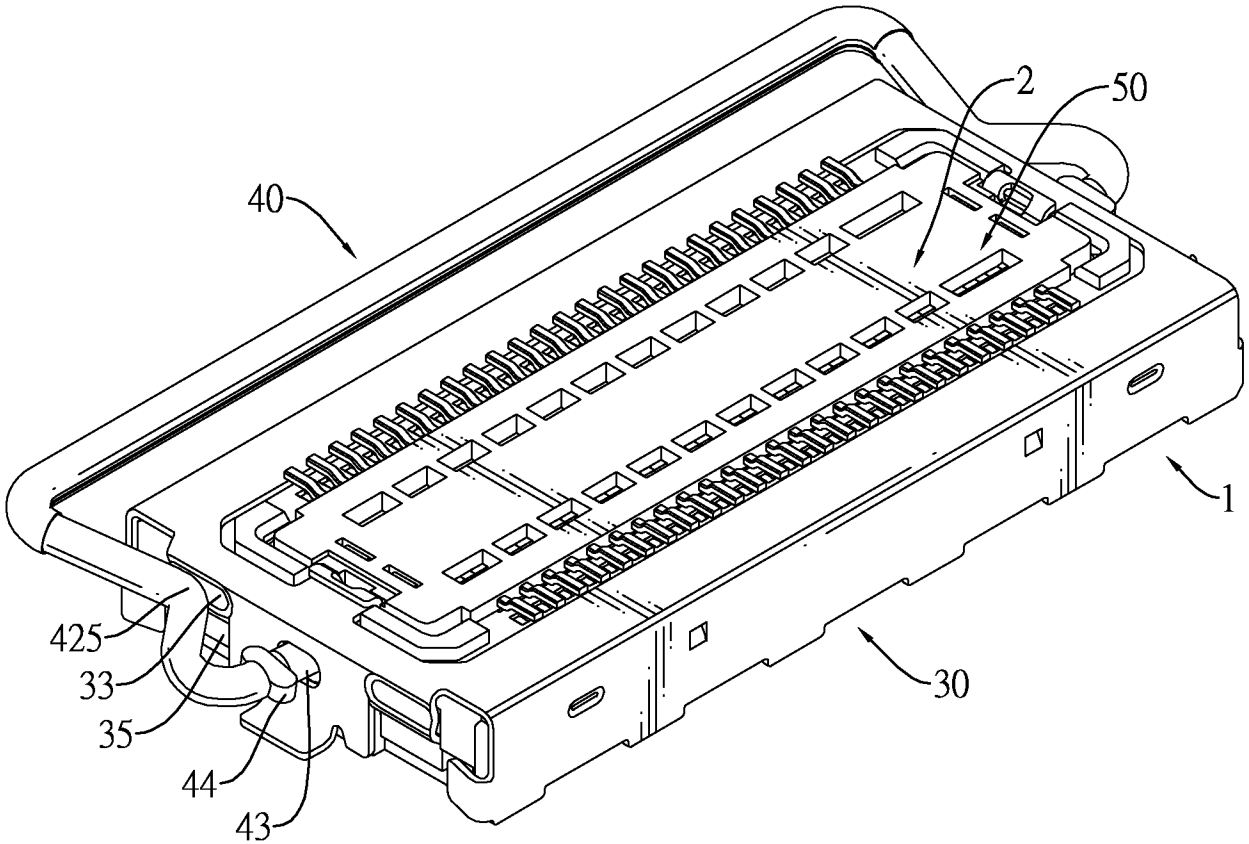
FIG. 1 is a perspective view of a board-to-board connector assembly in accordance with the present invention.
Figure 2:
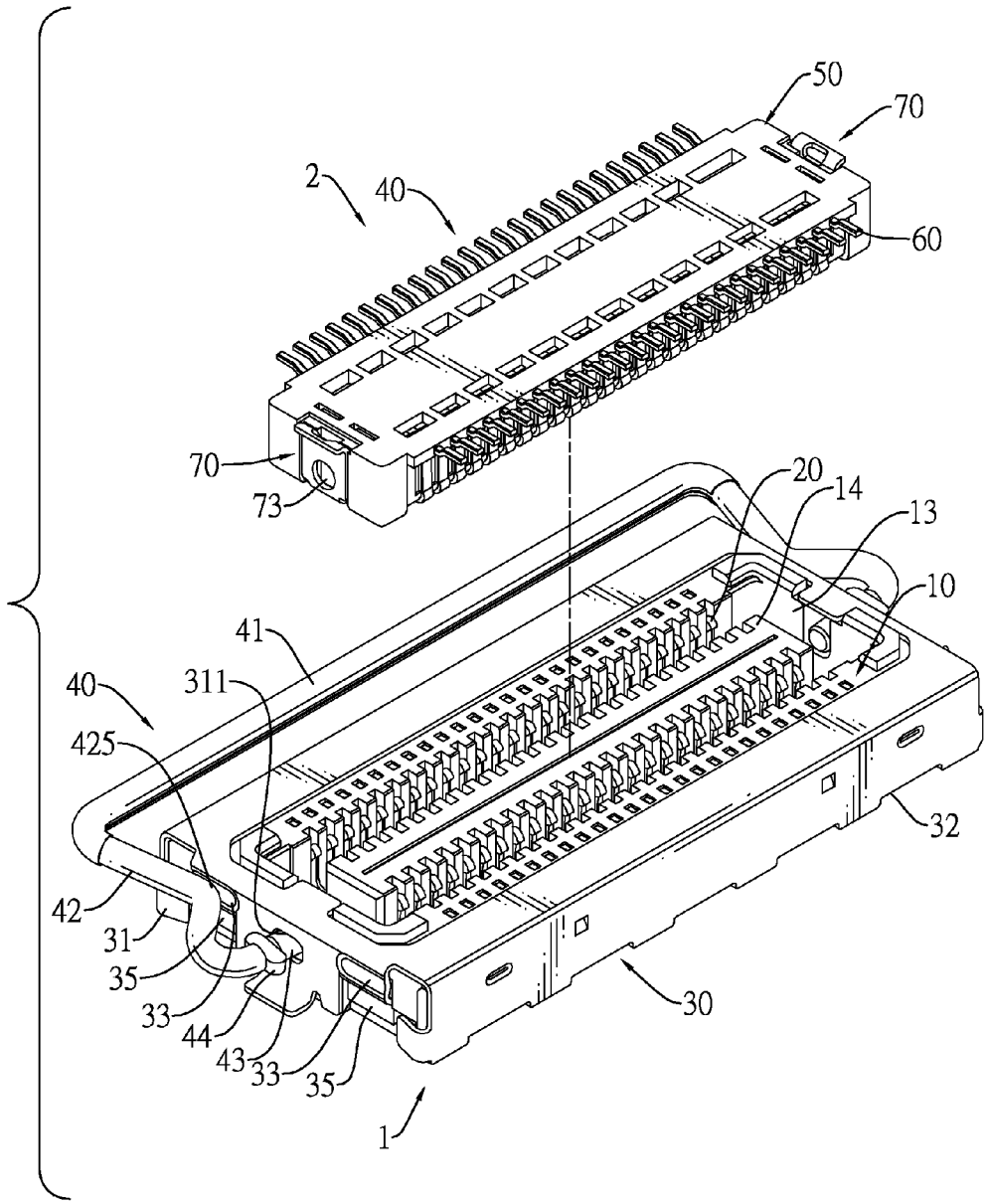
FIG. 2 is an exploded perspective view of the board-to-board connector assembly in FIG. 1.
Figure 3:
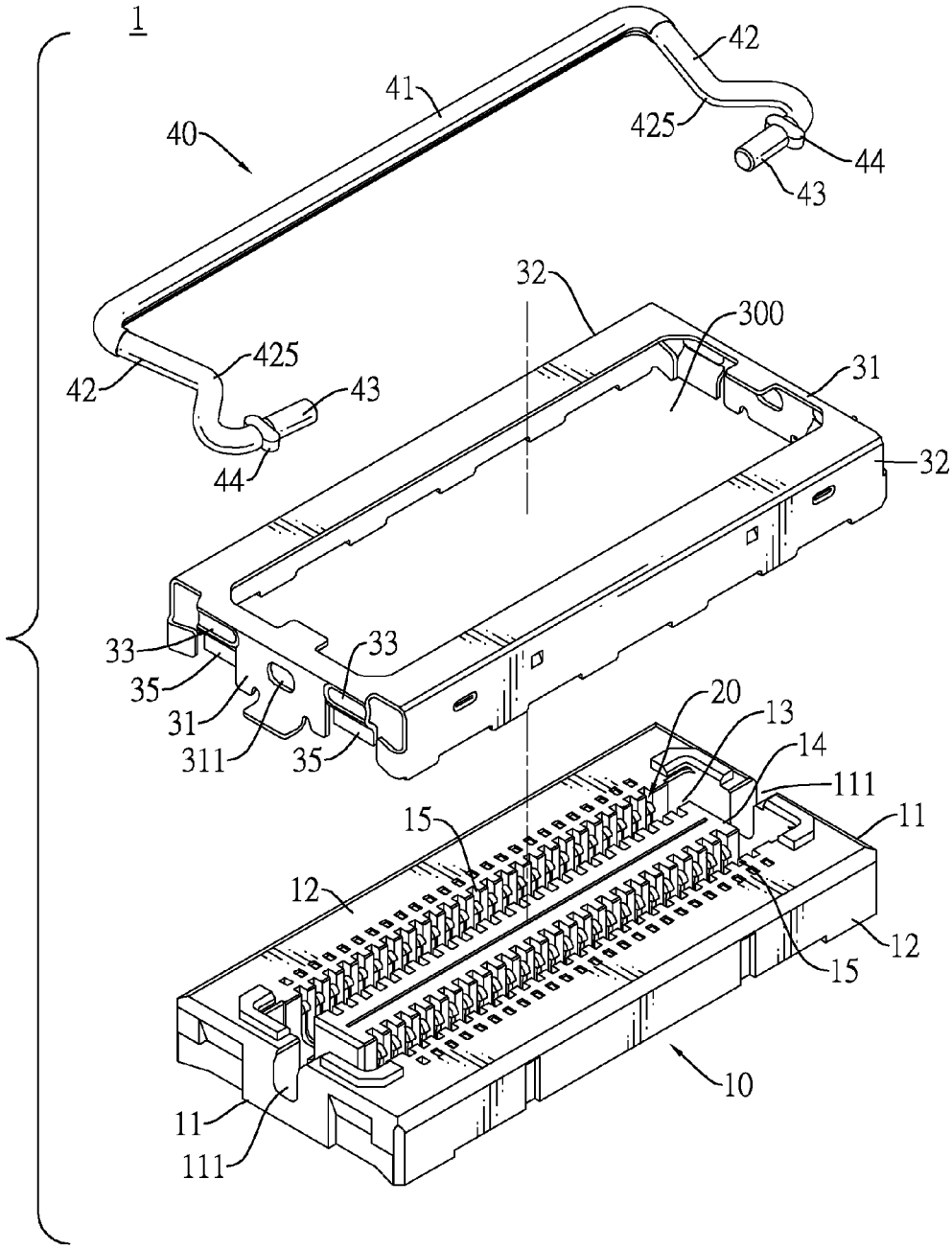
FIG. 3 is an exploded perspective view of a female connector of the board-to-board connector assembly in FIG. 1.

With reference to FIGS. 1 and 3, a board-to-board connector assembly in accordance with the present invention comprises a female connector 1 and a male connector 2.

Figure 4:
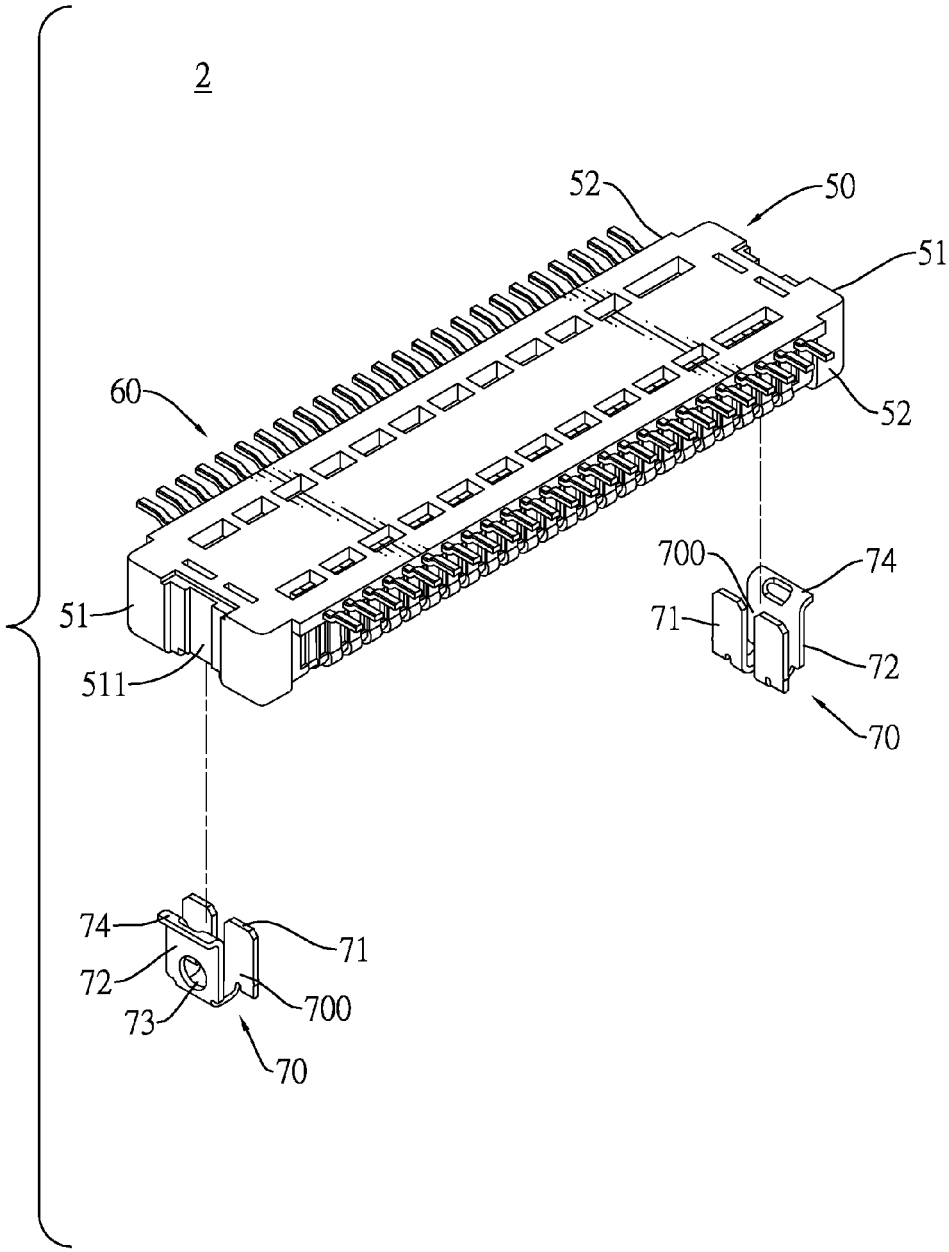
FIG. 4 is an exploded perspective view of a male connector of the board-to-board connector assembly in FIG. 1.

With further reference to FIG. 4, the female connector 1 may be mounted on a PCB such as a motherboard and comprises a first insulative housing 10, multiple first terminals 20, a shell 30 and a latching bar 40.

The first insulative housing 10 may be made of plastic, may be rectangular and has two opposite first edges 11, two opposite second edges, a top, a socket hole 13, a spine 14 and two assembling slots 111.

The socket hole 13 is defined in the top of the first insulative housing 10.

The spine 14 is formed in and protrudes upward from the socket hole 13.

The assembling slots 111 are defined respectively in the first edges 11.

The first terminals 20 are mounted in the socket hole 13.

The shell 30 may be made of metal, may be rectangular, is mounted on the first insulative housing 10 and has two opposite first sides 31, two opposite second sides 32, two sets of at least one locking recess 35, two sets of at least one releasing recess 33, two pivot holes 311 and an opening 300.

The sets of the at least one locking recess 35 are defined respectively in the first sides 31.

The sets of the at least one releasing recess 33 are defined respectively in the first sides 31 and are located respectively adjacent to and correspond to the sets of the at least one locking recess 35. Preferably, the at least one releasing recess 33 of each set may be stacked vertically with the at least one locking recess 35 of a corresponding set. A depth of each locking recess 35 is deeper than a depth of each releasing recess 33.

The pivot holes 311 are defined respectively through the first sides 31 of the shell 30.

The opening 300 is defined through the shell 30 and corresponds to the socket hole 13 of the first insulative housing 10.

The latching bar 40 may be made of metal, is mounted pivotally on the second sides 32 of the shell 30 and the second edges of the first insulative housing 10 and has a handling segment 41, two positioning segments 42, two latching pins 43 and two stoppers 44.

The handling segment 41 may be operated manually and has two ends.

The positioning segments 42 are formed on and protrude respectively from the ends of the handling segment 41 and each positioning segment 42 selectively engages the at least one locking recesses 35 of one set or the at least releasing recess 33 of one set. Furthermore, each positioning segment 42 may be V-shaped and have a positioning peak 425 selectively engaging one locking recess 35 or one releasing recess 33.

Two latching pins 43 are formed on and protrude respectively from the positioning segments 42 and rotatably and slidably extend respectively through the pivot holes 311 of the first sides 31 of the shell 30 and respectively in the assembling slots 111 of the first edges 11 of the first insulative housing 10.

The stoppers 44 are formed on and protrude transversely and respectively from the latching pins 43 and respectively abut the first sides 31 of the shell 30.

Furthermore, the latching bar 40 is resilient so that a distance between the latching pins 43 when each positioning segment 42 engages one locking recess 35 is shorter than a distance between the latching pins 43 when each positioning segment 42 engages one releasing recess 33.

Figure 5:
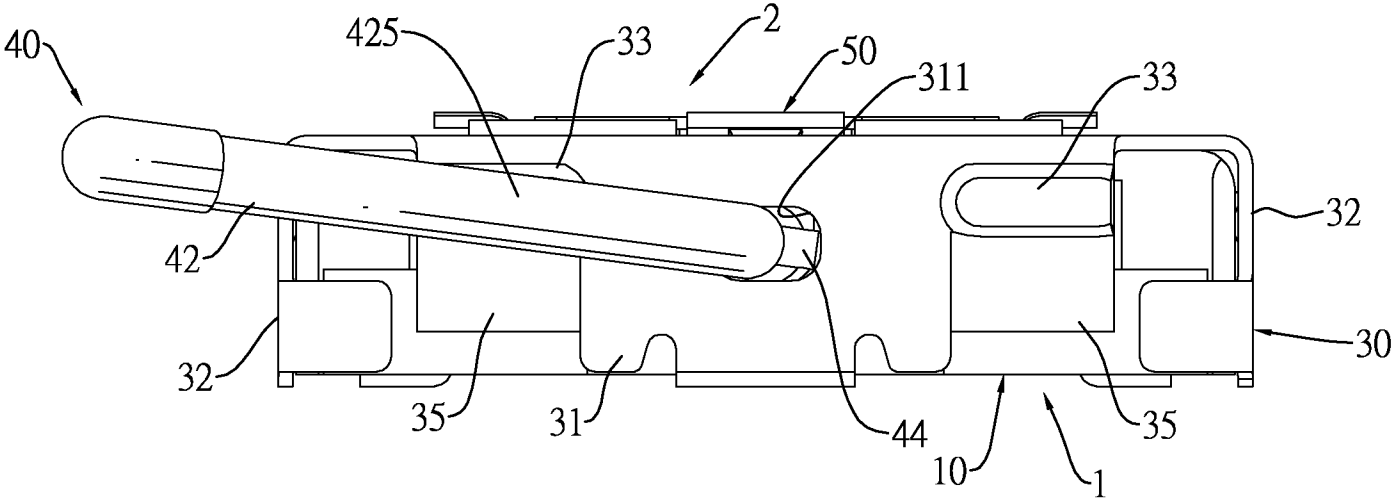
FIG. 5 is an end view of a positioning segment of a latching bar of the female connector located in a releasing recess of the board-to-board connector assembly in FIG. 1.

With further reference to FIG. 5, the male connector 2 may be mounted on another PCB such as an expansion card or a film circuit board, detachably engages the female connector 1 and comprises a second insulative housing 50, multiple second terminals 60 and two latched elements 70.

The second insulative housing 50 may be made of plastic, detachably engages the socket hole 13 of the first insulative housing 10 and has a bottom, two opposite first outer walls 51, two opposite second outer walls 52, two mounting boards 511 and an engaging slot.

The mounting boards 511 are formed on and downwardly protrude respectively from the first outer walls 51.

The engaging slot is defined in the bottom of the second insulative housing 50 and detachably engages the spine 14 of the first insulative housing 10.

The second terminals 60 are mounted in the second insulative housing 50 and selectively and respectively contact the first terminals 20.

The latched elements 70 may be made of metal, are mounted respectively on the first outer walls 51 of the second insulative housing 50 and each latched element 70 has a latched hole 73 defined through the latched element 70 and aligned with one of the latching pins 43. The latched elements 70 may serve as grounding terminals to ground the male connector 2. Preferably, each latched element 70 is U-shaped and has an inside tab 71, an outside tab 72 and a notch 700. The outside tab 72 is formed on and extends from the inside tab 71. The notch 700 is defined between the inside tab 71 and the outside tab 72 and engages one of the mounting boards 511. The latched holes 73 are defined respectively through the outside tabs 72. Furthermore, each outside tab 72 has a soldering tab 74 formed on and protruding from the outside tab 72. The soldering tab 74 may be soldered on the PCB to securely hold the male connector 2 on the PCB.

Figure 6:
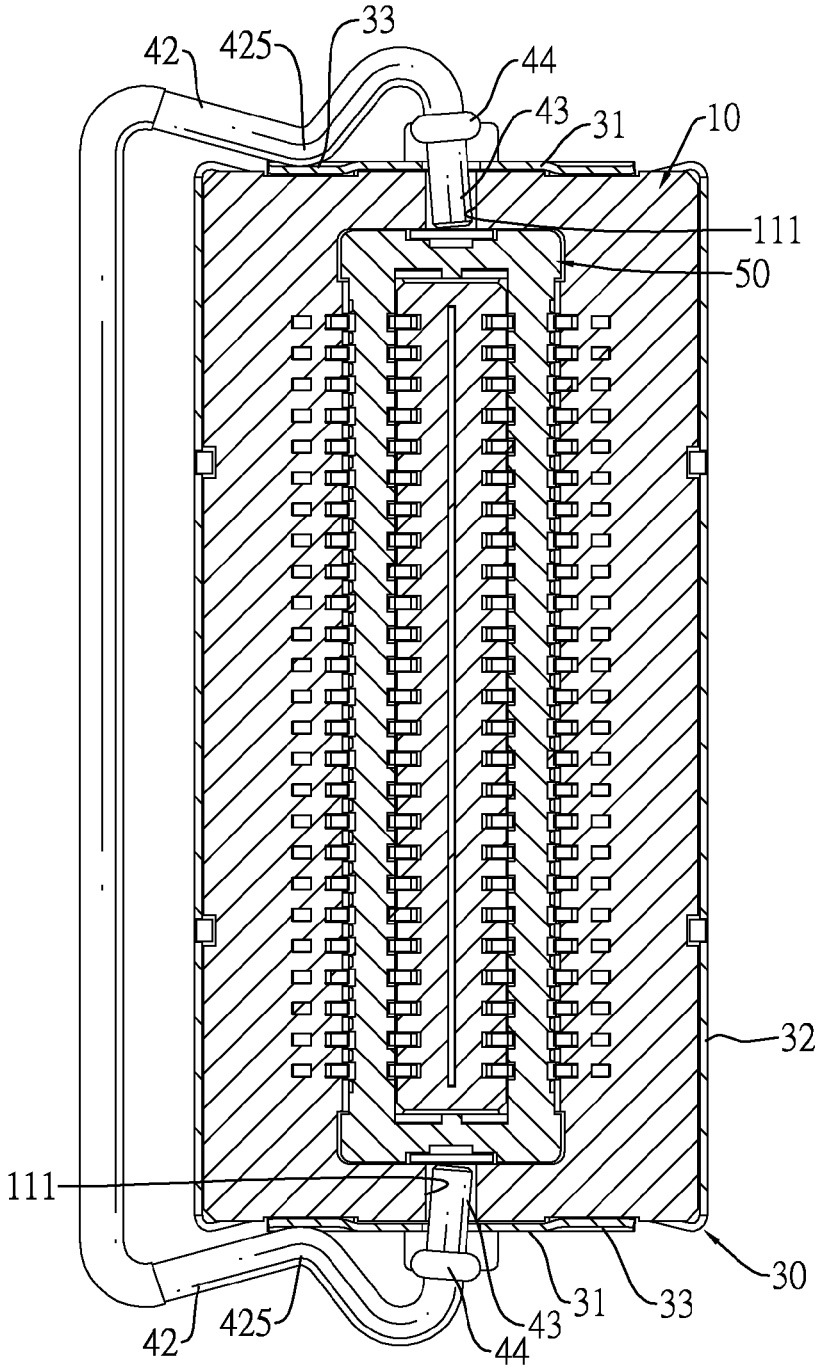
FIG. 6 is a top view in partial section of the board-to-board connector assembly in FIG. 5.

With further reference to FIGS. 5 and 6, when each positioning segment 42 of the latching bar 40 engages the at least one releasing recess 33 on one of the first sides 31 of the shell 30, the latching pins 43 disengage respectively from the latched holes 73 of the latched elements 70 so that the male connector 2 is able to be detached from the female connector 1.

Figure 7:
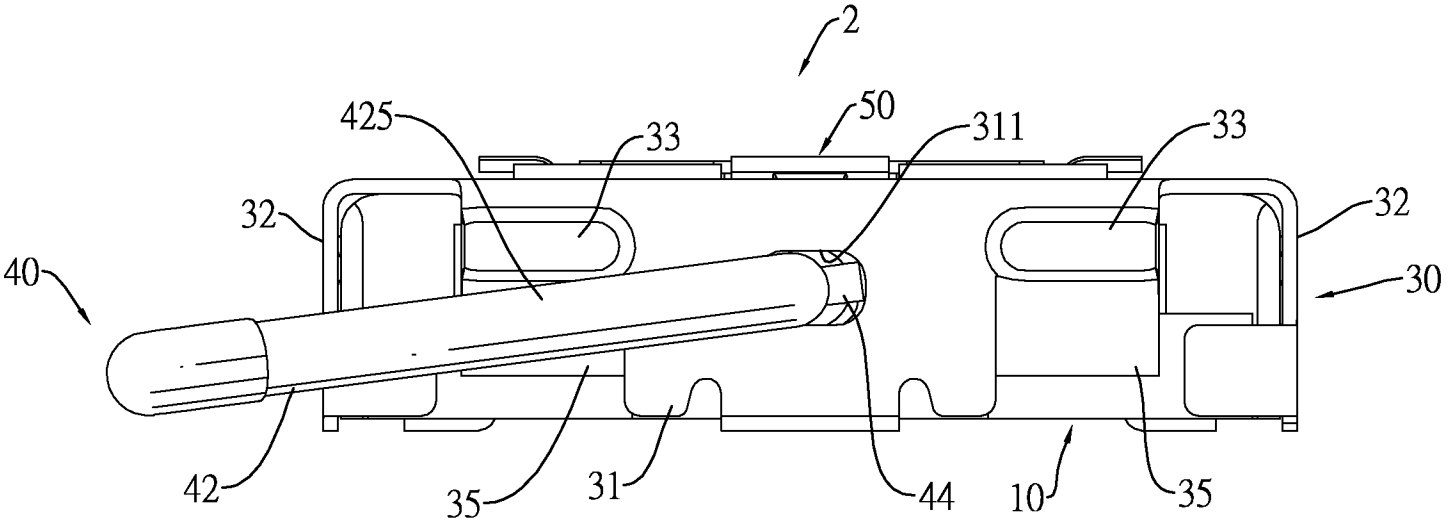
FIG. 7 is an end view of a positioning segment of a latching bar of the female connector located in a locking recess of the board-to-board connector assembly in FIG. 1.
Figure 8:
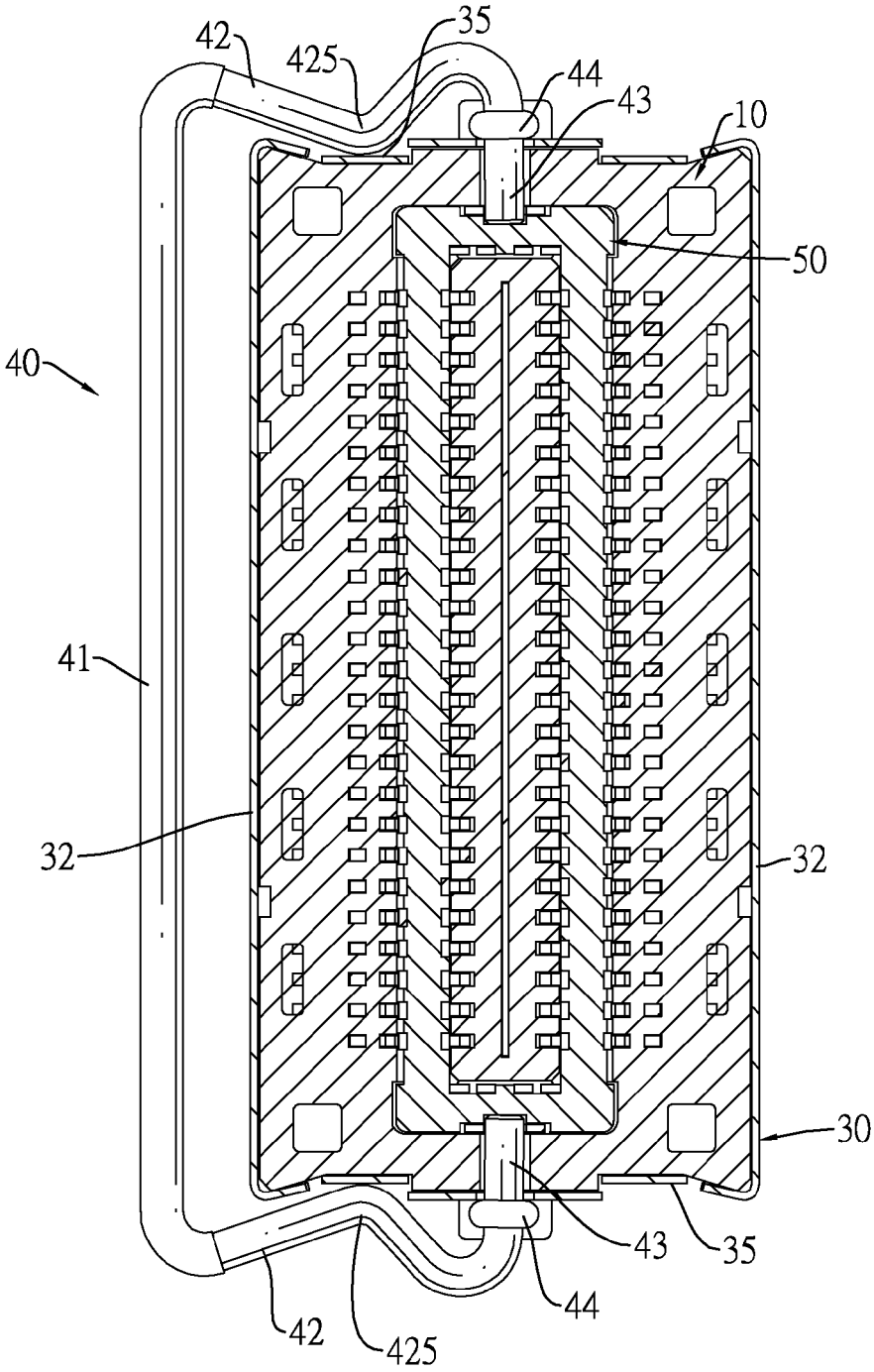
FIG. 8 is a top view in partial section of the board-to-board connector assembly in FIG. 7.

With further reference to FIGS. 7 and 8, when each positioning segment 42 of the latching bar 40 engages the at least one locking recess 35 on one of the first sides 31 of the shell 30, the latching pins 43 extend respectively in the latched holes 73 of the latched elements 70 to prevent the male connector 2 from inadvertently falling out of the female connector 1.

The present invention has the following advantages.

1. The latching pins 43 of the latching bar 40 selectively engage the latched holes 73 of the latched elements 70 so that the male connector 2 is securely locked and held on the female connector 1 without inadvertent disengagement.

2. The shell 30, latching bar 40 and latched elements 70 are made of metal with high structural strength and wearproof characteristic to provide excellent locking effects and durability. Furthermore, the metal material prevents the latching bar 40 from directly contacting, wearing and damaging the first or second insulative housing 10, 50 made of plastic.

3. The stoppers 44 on the latching pins 43 of the latching bar 40 prevent the latching pins 43 from excessively extending in the latched elements 70 and wearing the second insulative housing 50. Therefore, the durability of the male connector 2 is improved.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A board-to-board connector assembly comprising:

a female connector having:

a first insulative housing having:

two opposite first edges;

two opposite second edges;

a top; and a socket hole defined in the top of the first insulative housing;

multiple first terminals mounted in the socket hole;

a shell mounted on the first insulative housing and having:

two opposite first sides;

two opposite second sides;

two sets of at least one locking recess defined respectively in the first sides; and two sets of at least one releasing recess defined respectively in the first sides and located respectively adjacent to and corresponding to the sets of the at least one locking recess; and a latching bar mounted pivotally on the second sides of the shell and the second edges of the first insulative housing and having:

a handling segment having two ends;

two positioning segments formed on and protruding respectively from the ends of the handling segments and each positioning segment selectively engaging the at least one locking recess of one set or the at least one releasing recess of one set; and two latching pins formed on and protruding respectively from the positioning segments and rotatably and slidably extending respectively through the first sides of the shell and respectively in the first edges of the first insulative housing; and a male connector detachably engaging the female connector and having:

a second insulative housing detachably engaging the socket hole of the first insulative housing and having:

a bottom; and two opposite first outer walls; and multiple second terminals mounted in the second insulative housing and selectively and respectively contacting the first terminals; and two latched elements mounted respectively on the first outer walls of the second insulative housing and each latched element having a latched hole defined through the latched element and aligned with one of the latching pins, wherein when each positioning segment of the latching bar engages the at least one releasing recess on one of the first sides of the shell, the latching pins disengage respectively from the latched holes of the latched elements, and when each positioning segment of the latching bar engages the at least one locking recess on one of the first sides of the shell, the latching pins extend respectively in the latched holes of the latched elements.

2. The board-to-board connector assembly as claimed in claim 1, wherein the at least one releasing recess of each set is stacked vertically with the at least one locking recess of a corresponding set.

3. The board-to-board connector assembly as claimed in claim 2, wherein a depth of each locking recess is deeper than a depth of each releasing recess and the latching bar is resilient so that a distance between the latching pins when each positioning segment engages one locking recess is shorter than a distance between the latching pins when each positioning segment engages one releasing recess.

4. The board-to-board connector assembly as claimed in claim 3, wherein the latching bar further has two stoppers formed on and protruding transversely and respectively from the latching pins and respectively abutting the first sides of the shell.

5. The board-to-board connector assembly as claimed in claim 4, wherein each positioning segment of the latching bar is V-shaped and has a positioning peak selectively engaging one lock recess or one releasing recess.

6. The board-to-board connector assembly as claimed in claim 5, wherein the second insulative housing further has two mounting boards formed on and downwardly protruding respectively from the first outer walls; and each latched element is U-shaped and has an inside tab;

an outside tab formed on and extending from the inside tab; and a notch defined between the inside tab and the outside tab and engaging one of the mounting boards; and the latched holes are defined respectively through the outside tabs.

7. The board-to-board connector assembly as claimed in claim 6, wherein the first insulative housing further has two assembling slots defined respectively in the first edges and in which the latching pins extend respectively; and the shell further has two pivot holes defined respectively through the first sides and through which the latching pins extend respectively.

8. The board-to-board connector assembly as claimed in claim 7, wherein the latched elements serve as grounding terminals.

9. The board-to-board connector assembly as claimed in claim 8, wherein the outside tab of each latched element has a soldering tab formed on and protruding from the outside tab.

10. The board-to-board connector assembly as claimed in claim 9, wherein the shell further has an opening defined through the shell and corresponding to the socket hole of the first insulative housing.

11. The board-to-board connector assembly as claimed in claim 10, wherein the shell is made of metal, and the latched elements are made of metal.

12. The board-to-board connector assembly as claimed in claim 11, wherein the latching bar is made of metal.

* * * * *